US007082723B2

(12) United States Patent
Gramling

(10) Patent No.: US 7,082,723 B2
(45) Date of Patent: Aug. 1, 2006

(54) GUTTER RETAINING SYSTEM

(76) Inventor: Karl Gramling, 19950 Huebner Rd. #705, San Antonio, TX (US) 78258

( * ) Notice: Subject to any disclaimer, the term of this patent is extended or adjusted under 35 U.S.C. 154(b) by 381 days.

(21) Appl. No.: 10/693,473

(22) Filed: Oct. 24, 2003

(65) Prior Publication Data

US 2005/0016077 A1 Jan. 27, 2005

Related U.S. Application Data

(63) Continuation-in-part of application No. 10/623,222, filed on Jul. 21, 2003, now Pat. No. 6,935,074.

(51) Int. Cl.
*E04D 13/00* (2006.01)

(52) U.S. Cl. ..... 52/11

(58) Field of Classification Search ..... 52/12, 52/13, 14, 11

See application file for complete search history.

(56) References Cited

U.S. PATENT DOCUMENTS 3,296,749 A 1/1967 Cotter
3,333,803 A * 8/1967 Landis ..... 248/48.2
3,344,562 A 10/1967 Miles et al.
3,550,381 A 12/1970 South
3,612,453 A * 10/1971 Zimmer ..... 248/48.2
4,195,452 A 4/1980 Smith et al.
4,241,548 A 12/1980 Rowe
4,271,643 A 6/1981 Sweers
4,300,319 A 11/1981 Frost et al.
4,622,785 A * 11/1986 Miller ..... 52/11
4,705,242 A 11/1987 Yost
4,713,915 A * 12/1987 Sweers ..... 52/11
4,912,888 A 4/1990 Martin
5,740,633 A * 4/1998 Champagne ..... 52/11

* cited by examiner

*Primary Examiner*—Naoko Slack
*Assistant Examiner*—Jessica Laux
(74) *Attorney, Agent, or Firm*—Michelle Evans; Gunn & Lee, P.C.

(57) ABSTRACT

A gutter retaining system for affixing a gutter under the eaves of a building. The gutter retaining system incorporates a gutter clip with a gutter and retaining member. The retaining member is placed along the eaves. The gutter clip has an L-portion and a back portion. The back portion includes an upper u-portion with a hanger used to slip the gutter clip over the gutter to secure it to the gutter clip. The gutter clip has a nib end with a locking tip. Nib end fits within retaining member to secure gutter clip and gutter in place along the eaves. L-portion fits between the gutter and building where an additional piece of board is included in the construction. The gutter clip is scored between the back portion and L-portion allowing separation, such as when no additional piece of board is found along the eaves.

15 Claims, 4 Drawing Sheets

GUTTER RETAINING SYSTEM

This is a continuation in part application claiming priority to U.S. patent application Ser. No. 10/623,222 filed Jul. 21, 2003.

BACKGROUND OF THE INVENTION

1. Field of the Invention

Applicant's invention relates to a gutter retaining system for affixing a gutter to a building. More specifically, the present invention relates to an interlocking system that incorporates a clip for affixing gutters to a retaining member on the eaves of a building that obviates the need for using nails or screws within the gutter itself, and to the structure installed according to the system, both preassembly and as assembled.

2. Background Information

For years property owners have struggled with the destructive effects of water on their buildings. However, by channeling the water away from the structure, building owners can reduce the damage caused by water. This can be accomplished through the use of a gutter system. Gutters are troughs that channel water from the eaves, being the horizontal lower edge of a roof, of a building to the downspouts. The downspouts are essentially drainpipes that drain water from the roof gutters. Gutters are a critical component of a building because they prevent moisture damage by channeling water off the roof and away from the foundation. But any damaged lengths of gutter or drain pipe caused by wear, improper installation, or sagging can cause leaks which can result in water damage to the building.

Traditionally, gutters have been attached by nailing the gutter directly to the building. Building contractors typically used a spike and ferrule system, in which a narrow, tubular spacer, the ferrule, is placed between the front face of a gutter and its rear face, ensuring that the front face remains at a uniform distance from the rear face. A spike or long nail, is then punched through the outside of the front face of the gutter, through the ferrule, through the back face of the gutter, and into the wall or fascia of the structure.

Using the nail in this manner ruins the finished appearance of the gutter. In addition, once the gutter is installed it ends up with its front face tilted forward towards the ground. Once this occurs the captured rainwater and other material tends to pool along the outer edge of the gutter. The weight of this material creates a moment at the point of insertion of the nail, resulting in a force pulling the gutter away from the wall. Further, while this manner of installation has the effect (at least temporarily) of securing the gutter in place, it does not ensure that water will not run behind the gutter. In any structure where water is allowed to run and collect behind the gutter, eventually the integrity of the wood begins to weaken and the moment forces referred to above slowly pull the nail and the gutter away from the building. In periods of adverse weather, high winds can accelerate the process by getting behind the gutter and forcing it completely away from the building.

The utilization of gutter hangers is the most common way in which installers have tried to improve the integrity and life of gutter systems. In this application, a modified spacer is used, shaped like a flat plate, with both ends mined upward. One end of this spacer is inserted under the lip of the front face of the gutter, while the second end, with a pre-punched nail hole, is placed against the rear face of the gutter. A nail or screw is then inserted through the nail hole, through the rear face of the gutter, and into the building wall.

A variation of this method includes placing the second end of the spacer over the top of the rear face of the gutter. The spacer is then nailed directly into the roof decking of the building or to the face of the wall, under any existing shingles. These methods of installation eliminate the unsightly appearance previously created by installing the nail or screw through the front face of the gutter. However, these hangers do not prevent the collection of water behind the gutter, nor relieve the moment created by the weight of the water pooling outwardly within the gutter.

A further problem occurs with different types of construction. The building may or may not include an additional small piece of fascia board under the eaves which is not as long as the gutter. If a piece of fascia board does exist under the eaves and the gutter system is in turn nailed to it, over time the portion of the gutter which extends below the fascia board will sag towards the building. This sagging can eventually cause leaks. Where no additional fascia board exists, this type of sagging is not seen.

Because of the problems which have been associated with traditional gutter systems and methods of installation, there is a need for a strong, sturdy gutter system. In addition, this system should be adaptable to different types of construction that may or may not incorporate an additional piece of fascia board. It is desirable that installation be easy, while ensuring that any interlocking aspect of the system is not compromised due to the primary construction of the building nor during periods of high winds or other adverse weather conditions. Preferably, this system should redistribute the water and other material captured within the gutter, such that all moments that could result are negated. Furthermore, the system should prevent any sagging due to construction that incorporates an additional piece of fascia board.

SUMMARY OF THE INVENTION

The present invention embodies a gutter retaining system for affixing a rain gutter under the eaves of a building having a pitched roof. The gutter retaining system incorporates a gutter clip which is used in conjunction with a rain gutter and a retaining member. The gutter clip has an L-portion and a back portion. The back portion includes an upper u-portion with a hanger which is used to slip the gutter clip over the gutter. The back portion of the gutter clip also includes a nib end with a locking tip. Nib end extends slightly beyond the dimensions of the hanger and can fit within a hooked portion of the retaining member. This allows the locking tip to secure the gutter clip and gutter in place along the eaves of the building.

The L-portion of the gutter clip is useful on buildings which incorporate an additional piece of fascia board along the eaves in the construction. The L-portion fits between the gutter and the wall of the building, incorporating a base extension which can be fit against the building. In addition, the gutter clip is scored between the back portion and the L-portion which allows these two portions to be separated when desired, such as in the situation where no additional piece of fascia board is found along the eaves of the building. Where the L-portion is removed from the back portion, the L-portion would be discarded. In this situation, the vertical portion of the back portion presses against the building.

DETAILED DESCRIPTION OF THE PREFERRED EMBODIMENT

Figure 1:
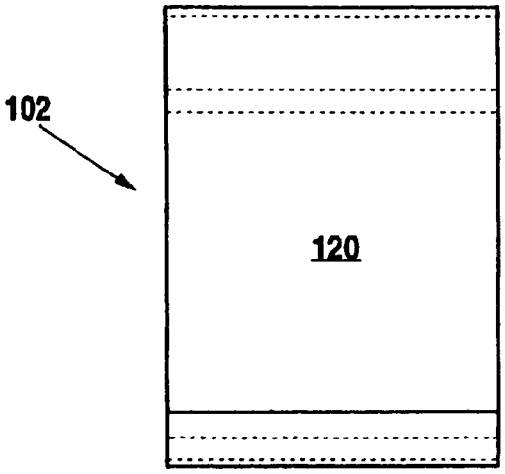
FIG. 1 is a front view of the gutter clip component of the preferred embodiment of the present invention.
Figure 2:
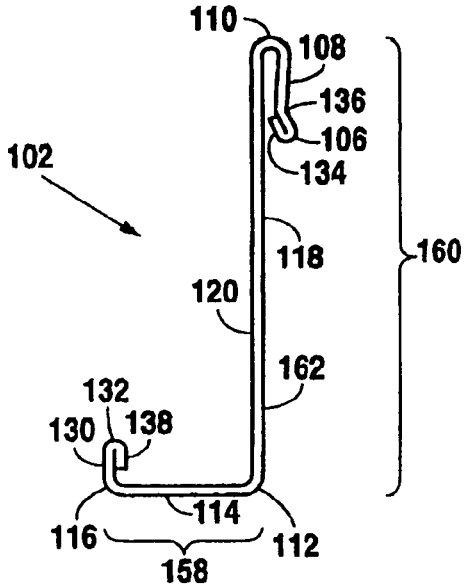
FIG. 2 is a side view of the gutter clip component of the preferred embodiment of the present invention.

In FIGS. 1 and 2 a front view and side view, respectively, of the gutter clip 102 of the preferred embodiment of the present invention are shown. Gutter clip 102 is essentially L-shaped incorporating an L-portion 158, a back portion 160, a front face 120 and back face 118. Beginning at the back portion 160 is locking tip 134 which is contiguous into nib end 106. Nib end 106 transitions into hanger 108 via junction 136. Hanger 108 is contiguous with upper u-portion 110. Upper u-portion 110 continues into vertical portion 162. Vertical portion 162 transitions into L-portion 158 which begins at first elbow 112. Scoring can be used on first elbow 112 to allow L-portion 158 to be easily separated from back portion 160. First elbow 112 turns into base 114 which proceeds into second elbow 116. Second elbow 116 turns up into base extension 130. Base extension 130 is contiguous with lower u-portion 132, lower u-portion 132 being completed at end 138.

Figure 3:
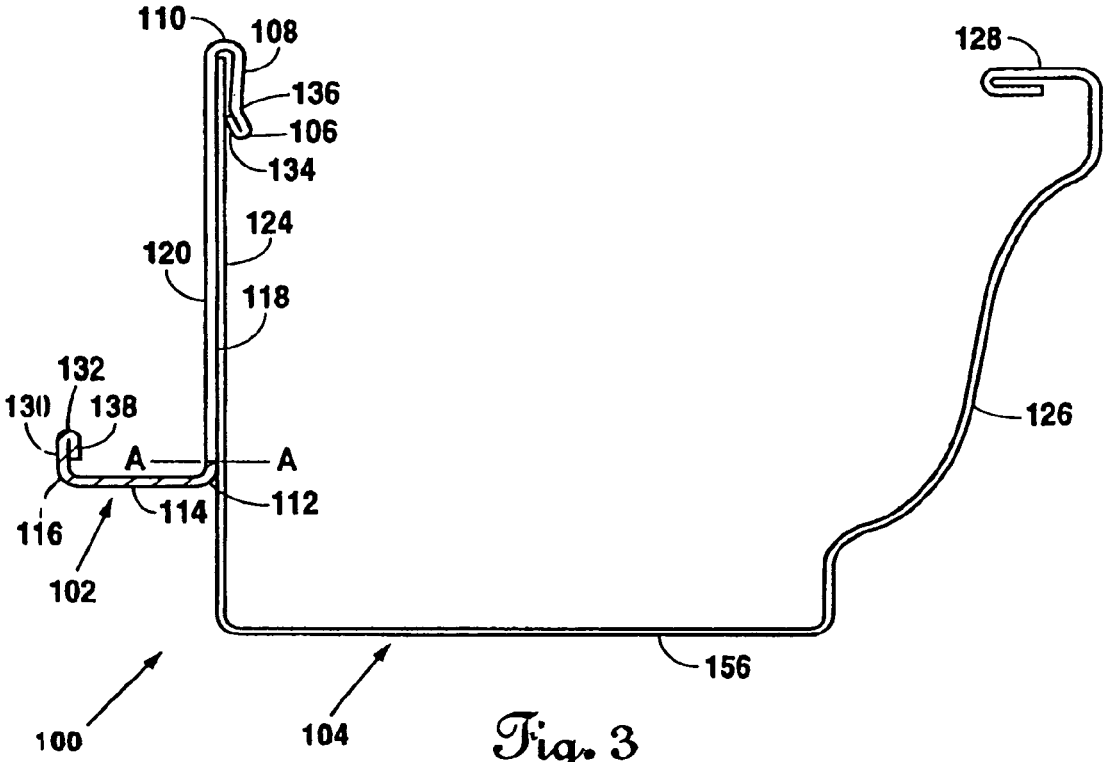
FIG. 3 is a cross-section view of the gutter clip component of the preferred embodiment of the present invention shown overlapping a gutter.

FIG. 3 shows a cross section view of the gutter clip 102 of the preferred 11 embodiment of the present invention overlapping a gutter 104. Gutter clip 102, gutter 104, and retaining member 122 make up a gutter retaining system 100. Gutter clip 102 is as mentioned essentially L-shaped incorporating an L-portion 158 (See FIG. 2), a back portion 160 (See FIG. 2), a front face 120 and back face 118. Beginning at the back portion 160 (See FIG. 2) is locking tip 134 which is adjacent nib end 106. Nib end 106 transitions into hanger 108 via junction 136. Hanger 108 continues into upper u-portion 110. The portion of gutter clip 102 from locking tip 134 to upper u-portion 110 fits inside the back wall 124 of gutter 104. Upper u-portion 110 can be crimped to secure gutter clip 102 snugly to gutter 104. Back face 118 fits against the outside of the back wall 124 of gutter 104 from upper u-portion 110 to first elbow 112. Upper u-portion 110 of gutter clip 102 continues into vertical portion 162. Vertical portion 162 transitions into L-portion 158 (See FIG. 2) which begins at first elbow 112. First elbow 112 turns into base 114 which proceeds into second elbow 116. Second elbow 116 turns up into base extension 130. Base extension 130 is contiguous with lower u-portion 132, lower u-portion 132 being completed at end 138. The remainder of gutter 104 includes a gutter channel 156, front wall 126 and lip 128.

Figure 4A:
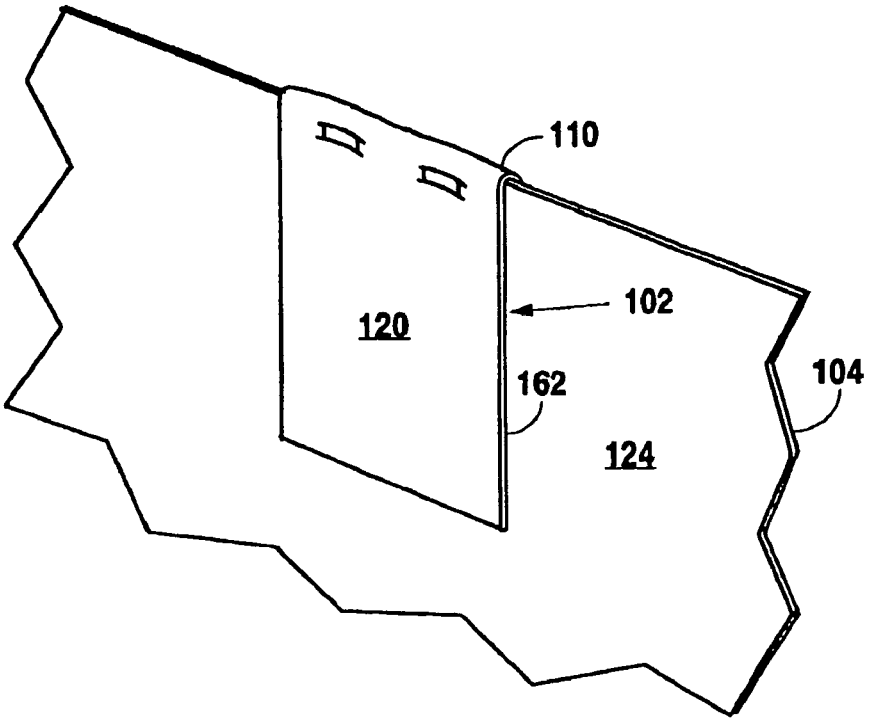
FIG. 4A is a perspective view of the gutter clip component of the preferred embodiment of the present invention with the L-portion removed.

FIG. 4A is a perspective view of the gutter clip 102 of the preferred embodiment of the present invention with the L-portion 158 (See FIG. 2) removed. Beginning at the back portion 160 (See FIG. 2) is locking tip 134 (See FIG. 3) which is contiguous into nib end 106 (See FIG. 3). Nib end 106 (See FIG. 3) transitions into hanger 108 (See FIG. 3) via junction 136 (See FIG. 3). Hanger 108 (See FIG. 3) is contiguous with upper u-portion 110. Upper u-portion 110 can be crimped to secure gutter clip 102 snugly to gutter 104. Back face 118 (See FIG. 3) fits against the outside of the back wall 124 of gutter 104. Upper u-portion 110 of gutter clip 102 continues into vertical portion 162.

Figure 4B:
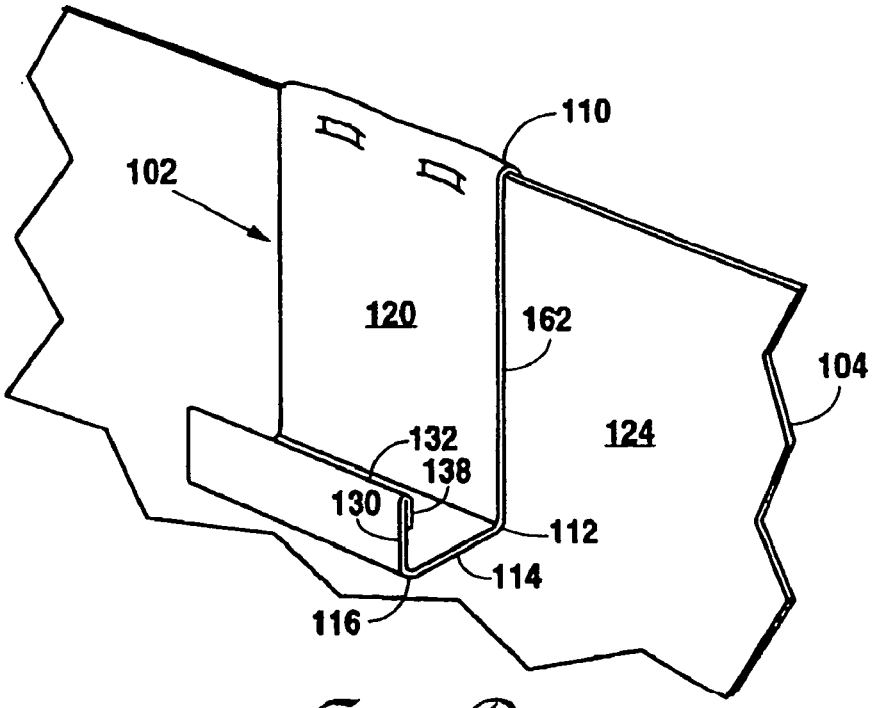
FIG. 4B is a perspective view of the gutter clip component of the preferred embodiment of the present invention retaining the L-portion.

In FIG. 4B a perspective view of the gutter clip 102 of the preferred embodiment of the present invention retaining the L-portion 158 (See FIG. 2) is shown. Beginning at the back portion 160 (See FIG. 2) is locking tip 134 (See FIG. 3) which is contiguous into nib end 106 (See FIG. 3). Nib end 106 (See FIG. 3) transitions into hanger 108 (See FIG. 3) via junction 136 (See FIG. 3). Hanger 108 (See FIG. 3) is contiguous with upper u-portion 110. The portion of gutter clip 102 from locking tip 134 (See FIG. 3) to upper u-portion 110 fits inside the back wall 124 of gutter 104. Upper u-portion 110 can be crimped to secure gutter clip 102 snugly to gutter 104. Back face 118 (See FIG. 3) fits against the outside of the back wall 124 of gutter 104 from upper u-portion 110 to first elbow 112. Upper u-portion 110 of gutter clip 102 continues into vertical portion 162. Vertical portion 162 transitions into L-portion 158 (See FIG. 3) which begins at first elbow 112. First elbow 112 turns into base 114 which proceeds into second elbow 116. Second elbow 116 turns up into base extension 130. Base extension 130 is contiguous with lower u-portion 132, lower u-portion 132 being completed at end 138.

Figure 5:
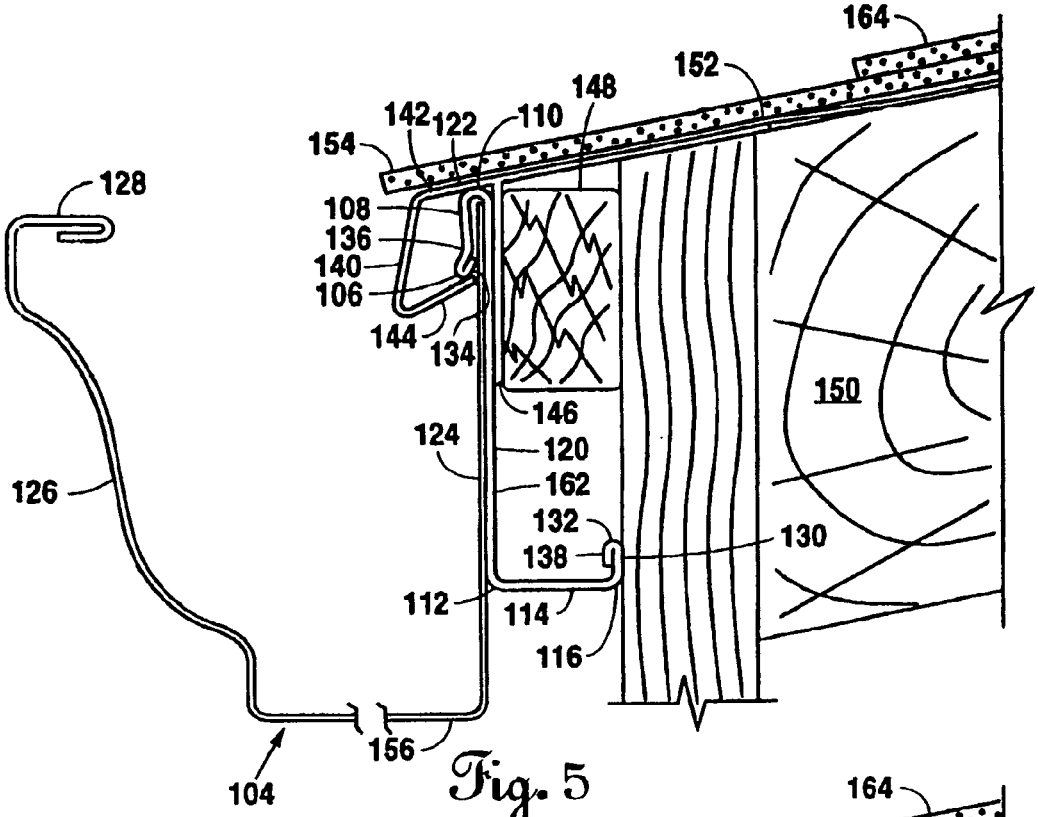
FIG. 5 is a cross-section view of the gutter clip component of the preferred embodiment of the present invention retaining the L-portion as shown with a gutter and retaining member against a building.

FIG. 5 is a cross-section view of the gutter clip 102 of FIG. 4B of the preferred embodiment of the present invention retaining the L-portion 158 (See FIG. 2) as shown with a gutter 104 and retaining member 122 against a building 150. Beginning at the back portion 160 (See FIG. 2) is locking tip 134 which is contiguous into nib end 106. Nib end 106 transitions into hanger 108 via junction 136. Hanger 108 is contiguous with upper u-portion 110. The portion of gutter clip 102 from locking tip 134 to upper u-portion 110 fits inside the back wall 124 of gutter 104. Upper u-portion 110 can be crimped to secure gutter clip 102 snugly to gutter 104.

Front face 120 fits against mounting lip 146 of retaining member 122. Mounting lip 146 ends in horizontal section 142. One end of horizontal section 142 proceeds under the roof 152 tiles 164 while the remaining end drops into a return 140. Return 140 ends in hooked portion 144. Nib end 106 extends slightly beyond the dimensions of hanger 108 and therefore can fit within hooked portion 144 to allow locking tip 134 to secure gutter clip 102 and gutter 104 in place. The back of mounting lip 146 presses against a fascia board 148 on building 150. The thickness of L-portion 158 (See FIG. 2) is approximately equal to the thickness of fascia board 148 to allow for base extension 130 to fit properly against building 150. In buildings 150 which incorporate this fascia board 148, L-portion 158 (See FIG. 2) provides stability to gutter 104 to prevent gutter 104 from sagging towards building 150. The vertical portion 162 of gutter clip 102 as well as the upper u-portion 110, hanger 108, nib end 106, junction 136 and locking tip 134 of gutter clip 102 are positioned under the eaves 154 of building 150. A portion of horizontal section 142, return 140 and hooked portion 144 of retaining member 122 are positioned under the eaves 154 of building 150 as is gutter 104.

Back face 118 (See FIG. 3) fits against the outside of the back wall 124 of gutter 104 from upper u-portion 110 to first elbow 112. Upper u-portion 110 of gutter clip 102 continues into vertical portion 162. Vertical portion 162 transitions into L-portion 158 (See FIG. 2) which begins at first elbow 112. First elbow 112 turns into base 114 which proceeds into second elbow 116. Second elbow 116 turns up into base extension 130. Base extension 130 is designed to fit against building 150. Base extension 130 is contiguous with lower u-portion 132, lower u-portion 132 being completed at end 138. The remainder of gutter 104 includes a gutter channel 156, front wall 126 and lip 128.

Figure 6:
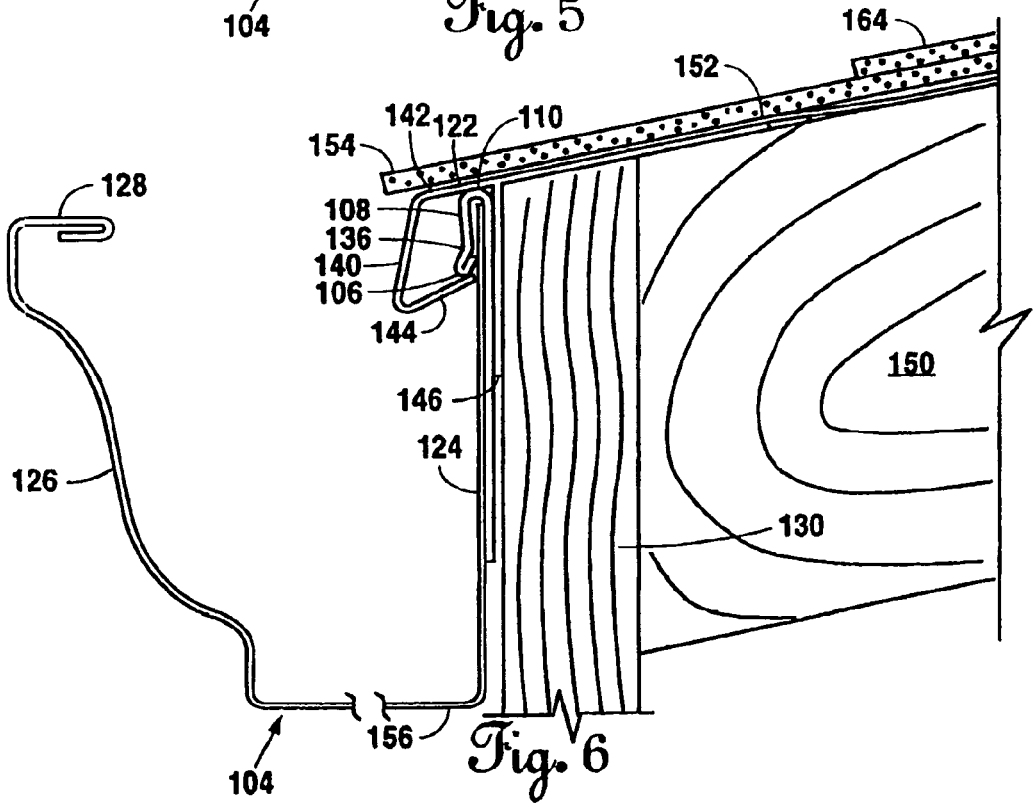
FIG. 6 is a cross-section view of the gutter clip component of the preferred embodiment of the present invention without the L-portion with a gutter and retaining member against a building.

FIG. 6 shows a cross-section view of the gutter clip 102 of FIG. 4A of the preferred embodiment of the present invention without the L-portion 158 (See FIG. 2) with a gutter 104 and retaining member 122 against a building 150. Beginning at the back portion 160 (See FIG. 2) is locking tip 134 which is contiguous into nib end 106. Nib end 106 transitions into hanger 108 via junction 136. Hanger 108 is contiguous with upper u-portion 110. The portion of gutter clip 102 from locking tip 134 to upper u-portion 110 fits inside the back wall 124 of gutter 104. Upper u-portion 110 can be crimped to secure gutter clip 102 snugly to gutter 104.

Front face 120 fits against mounting lip 146 of retaining member 122. Mounting lip 146 ends in horizontal section 142. One end of horizontal section 142 proceeds under the roof 152 tiles 164 while the remaining end drops into a return 140. Return 140 ends in hooked portion 144. Nib end 106 extends slightly beyond the dimensions of hanger 108 and therefore can fit within hooked portion 144 to allow locking tip 134 to secure gutter clip 102 and gutter 104 securely in place. The back of mounting lip 146 presses against building 150. The vertical portion 162 of gutter clip 102 as well as the upper u-portion 110, hanger 108, nib end 106, junction 136 and locking tip 134 of gutter clip 102 are positioned under the eaves 154 of building 150. A portion of horizontal section 142, return 140 and hooked portion 144 of retaining member 122 are positioned under the eaves 154 of building 150 as is gutter 104. Back face 118 (See FIG. 3) fits against the outside of the back wall 124 of gutter 104. Upper u-portion 110 of gutter clip 102 continues into vertical portion 162. The remainder of gutter 104 includes a gutter channel 156, front wall 126 and lip 128.

Figure 7:
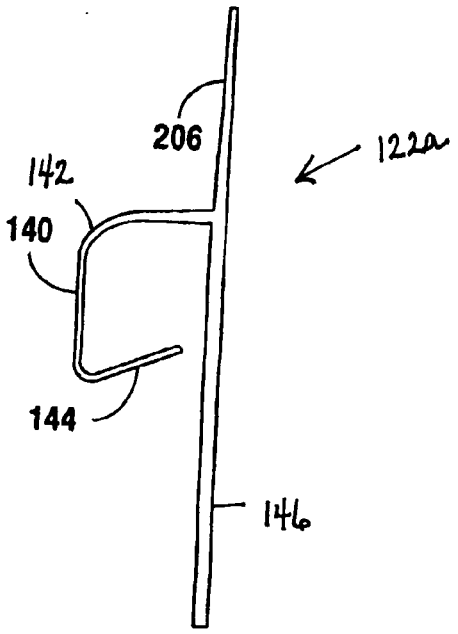
FIG. 7 is a cross-section view of the retaining member of the second embodiment of the present invention.

FIG. 7 is a cross-section view of the retaining member 122*a* of the second embodiment of the present invention. Mounting lip 146 is provided which is contiguous with upper vertical section 206. At the junction between mounting lip 146 and upper vertical section 206 is one end of horizontal section 142. The remainder of horizontal section 142 drops into return. Return 140 ends in hooked portion 144.

Figure 8:
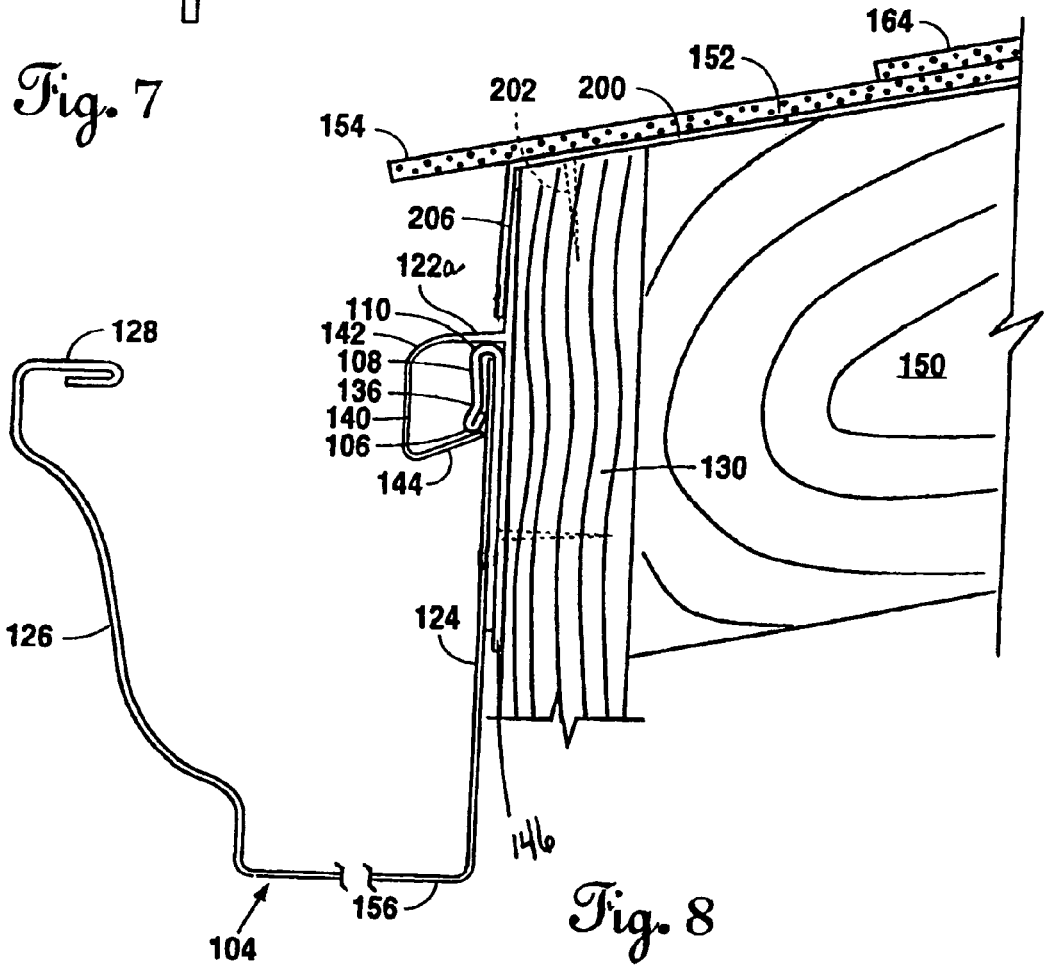
FIG. 8 is a cross-section view of the gutter clip component of the preferred embodiment of the present invention without the L-portion with a gutter and the retaining member of the second embodiment against a building incorporating metal flashing.

FIG. 8 is a cross-section view of the gutter clip component 102 (See FIG. 4A) of the preferred embodiment of the present invention without the L-portion 158 (See FIG. 2) with a gutter 104 and the retaining member 122*a* of the second embodiment against a building 150 incorporating metal flashing 200 held in place with nails 202. Beginning at the back portion 160 (See FIG. 2) is locking tip 134 (See FIG. 5) which is contiguous into nib end 106. Nib end 106 transitions into hanger 108 via junction 136. Hanger 108 is contiguous with upper u-portion 110. The portion of gutter clip 102 from locking tip 134 (See FIG. 5) to upper u-portion 110 fits inside the back wall 124 of gutter 104. Upper u-portion 110 can be crimped to secure gutter clip 102 snugly to gutter 104.

Front face 120 (See FIG. 2) fits against mounting lip 146 of retaining member 122*a*. Mounting lip 146 is contiguous with upper vertical section 206. Upper vertical section 206 is designed to extend in front of or behind metal flashing 200. In addition, upper vertical section 206 can be used when no metal flashing 200 is provided. At the junction between mounting lip 146 and upper vertical section 206 is one end of horizontal section 142. The remainder of horizontal section 142 drops into return 140. Return 140 ends in hooked portion 144. Nib end 106 extends slightly beyond the dimensions of hanger 108 and therefore can fit within hooked portion 144 to allow locking tip 134 (See FIG. 5) to secure gutter clip 102 and gutter 104 securely in place. The back of mounting lip 146 presses against building 150. The vertical portion 162 (See FIG. 4A) of gutter clip 102 as well as the upper u-portion 110, hanger 108, nib end 106, junction 136 and locking tip 134 (See FIG. 5) of gutter clip 102 are positioned under the eaves 154 of building 150. A portion of horizontal section 142, return 140 and hooked portion 144 of retaining member 122 are positioned under the eaves 154 of building 150 as is gutter 104. Back face 118 (See FIG. 3) fits against the outside of the back wall 124 of gutter 104. Upper u-portion 110 of gutter clip 102 continues into vertical portion 162 (See FIG. 4A). The remainder of gutter 104 includes a gutter channel 156, front wall 126 and lip 128.

The second embodiment can also incorporate the gutter clip 102 having the L-portion 158 as shown in FIG. 2. Beginning at the back portion 160 (See FIG. 2) is locking tip 134 which is contiguous into nib end 106. Nib end 106 transitions into hanger 108 via junction 136. Hanger 108 is contiguous with upper u-portion 110. The portion of gutter clip 102 from locking tip 134 (See FIG. 5) to upper u-portion 110 fits inside the back wall 124 of gutter 104. Upper u-portion 110 can be crimped to secure gutter clip 102 snugly to gutter 104.

Front face 120 (See FIG. 2) fits against mounting lip 146 of retaining member 122. Mounting lip 146 is contiguous with upper vertical section 206. At the junction between mounting lip 146 and upper vertical section 206 is one end of horizontal section 142. The remainder of horizontal section 142 drops into return 140. Return 140 ends in hooked portion 144. Nib end 106 extends slightly beyond the dimensions of hanger 108 and therefore can fit within hooked portion 144 to allow locking tip 134 (See FIG. 5) to secure gutter clip 102 and gutter 104 in place. The back of mounting lip 146 presses against a building 150. The thickness of L-portion 158 (See FIG. 2) allows for base extension 130 to fit properly against building 150. L-portion 158 (See FIG. 2) provides stability to gutter 104 to prevent gutter 104 from sagging towards building 150. The vertical portion 162 (See FIG. 2) of gutter clip 102 as well as the upper u-portion 110, hanger 108, nib end 106, junction 136 and locking tip 134 (See FIG. 5) of gutter clip 102 are positioned adjacent building 150. A portion of horizontal section 142, return 140 and hooked portion 144 of retaining member 122 are adjacent building 150 as is gutter 104.

Back face 118 (See FIG. 3) fits against the outside of the back wall 124 of gutter 104 from upper u-portion 110 to first elbow 112 (See FIG. 3). Upper u-portion 110 of gutter clip 102 continues into vertical portion 162 (See FIG. 2). Vertical portion 162 (See FIG. 2) transitions into L-portion 158 (See FIG. 2) which begins at first elbow 112 (See FIG. 3). First elbow 112 (See FIG. 3) turns into base 114 (See FIG. 3) which proceeds into second elbow 116 (See FIG. 3). Second elbow 116 (See FIG. 3) turns up into base extension 130 (See FIG. 3). Base extension 130 (See FIG. 3) is designed to fit against building 150. Base extension 130 (See FIG. 3) is contiguous with lower u-portion 132 (See FIG. 3), lower u-portion 132 (See FIG. 3) being completed at end 138 (See FIG. 3). The remainder of gutter 104 includes a gutter channel 156, front wall 126 and lip 128.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A gutter retaining system for mounting a rain gutter to a building comprising:

a retaining member comprising a mounting lip adjacent an upper vertical portion, said upper vertical portion for placement under a metal flashing of said roof; a horizontal section adjacent said mounting lip with one end of said horizontal section forming a return; and a hooked portion positioned at the end of return; and a gutter clip adjacent said retaining member, said gutter clip comprising a locking tip contiguous with a nib end whereby said nib end fits within said hooked portion to allow said locking tip to secure said gutter clip and said gutter in place.

2. The gutter retaining system for mounting a rain gutter to a building of claim 1 wherein said gutter comprises a channel formed by a front wall and a back wall.

3. The gutter retaining system for mounting a rain gutter to a building of claim 1 wherein said upper vertical section extends vertically from said mounting lip at a junction.

4. The gutter retaining system for mounting a rain gutter to a building of claim 3 wherein said horizontal section extends from the junction of said upper vertical section and said mounting lip.

5. The gutter retaining system for mounting a rain gutter to a building of claim 1 wherein said nib end of said gutter clip is adjacent a hanger portion.

6. The gutter retaining system for mounting a rain gutter to a building of claim 5 wherein said hanger portion is contiguous with a u-portion of said gutter clip.

7. The gutter retaining system for mounting a rain gutter to a building of claim 6 wherein a second end of said u-portion is contiguous with a vertical portion of said gutter clip.

8. The gutter retaining system for mounting a rain gutter to a building of claim 7 wherein said hanger portion and said vertical portion are approximately parallel with said nib end angled outwardly from said hanger portion and said locking tip being angled inwardly toward said vertical portion from said nib end.

9. The gutter retaining system for mounting a rain gutter to a building of claim 8 wherein said gutter clip further comprises a base adjacent said vertical portion.

10. The gutter retaining system for mounting a rain gutter to a building of claim 9 wherein said gutter clip further comprises an extension adjacent said base.

11. The gutter retaining system for mounting a rain gutter to a building of claim 10 wherein said gutter clip comprises a back face for situation against a back wall of said gutter.

12. The gutter retaining system for mounting a rain gutter to a building of claim 11 wherein said gutter clip further comprises a first elbow between said vertical portion and said base.

13. The gutter retaining system for mounting a rain gutter to a building of claim 12 wherein said gutter clip further comprises a second elbow between said base and said extension.

14. The gutter retaining system for mounting a rain gutter to a building of claim 13 wherein said gutter clip further comprises a lower u-portion adjacent said extension.

15. The gutter retaining system for mounting a rain gutter to a building of claim 14 wherein said gutter clip further comprises an end adjacent said lower u-portion.

* * * * *